US006863203B2

(12) United States Patent
Cismoski

(10) Patent No.: US 6,863,203 B2
(45) Date of Patent: Mar. 8, 2005

(54) EPOXY PUTTY STICK HOLDER

(75) Inventor: Jerry Cismoski, Chicago, IL (US)

(73) Assignee: Val-A Chicago Incorporated, Chicago, IL (US)

( * ) Notice: Subject to any disclaimer, the term of this patent is extended or adjusted under 35 U.S.C. 154(b) by 40 days.

(21) Appl. No.: 10/078,835

(22) Filed: Feb. 19, 2002

(65) Prior Publication Data

US 2003/0155277 A1 Aug. 21, 2003

(51) Int. Cl.[7] ..... B26F 3/02

(52) U.S. Cl. ..... 225/43; 225/39; 30/299; 206/446; 206/748

(58) Field of Search ..... 206/446, 748; 225/39, 43, 90; 83/30, 946, 660; 30/125, 299; 222/80

(56) References Cited

U.S. PATENT DOCUMENTS

| | | | | | |
|---|---|---|---|---|---|
| 1,121,062 | A | * | 12/1914 | Bauer | 225/19 |
| 2,724,178 | A | | 11/1955 | Gensburg | |
| 3,337,028 | A | * | 8/1967 | Glavan | 206/315.11 |
| 3,485,562 | A | | 12/1969 | Hidden et al. | |
| 3,774,609 | A | | 11/1973 | Schwartzman | |
| 3,889,804 | A | | 6/1975 | Ravich | |
| 4,027,985 | A | | 6/1977 | Loesser, III | |
| 4,516,884 | A | | 5/1985 | Douty | |
| 4,563,103 | A | | 1/1986 | Van Overloop et al. | |
| 4,648,537 | A | * | 3/1987 | Battig | 225/43 |
| 4,735,509 | A | | 4/1988 | Rausch | |
| 5,154,321 | A | | 10/1992 | Shomer | |
| 2001/0002563 | A1 | * | 6/2001 | Sigwart et al. | 83/30 |

* cited by examiner

*Primary Examiner*—David T. Fidei
(74) *Attorney, Agent, or Firm*—Ladas & Parry LLP

(57) ABSTRACT

An epoxy putty stick holder which has a plurality of wall portions connected to each other by a flexible joint, able to wrap around and store an epoxy putty stick. The inner surfaces of the wall portions have a tooth portion which is used to cut-off a portion of the epoxy putty stick, and a peg portion that puncture the cut-off portion of the epoxy putty stick to initiate the chemical reaction in a two-port epoxy stick. A lip portion is also located on the inner surface of the wall portions to hold the unused portion of the epoxy stick within the holder between the lip portion and the tooth portion, when the holder is wrapped around the epoxy stick in the holder's closed position.

14 Claims, 3 Drawing Sheets

EPOXY PUTTY STICK HOLDER

BACKGROUND OF THE INVENTION

1. Field of the Invention

The invention relates generally to a holder for an epoxy putty stick. More particularly, the invention relates to a holder for a two-part epoxy putty stick which also measures and cuts a specific amount of the epoxy stick, at the same time initiating the chemical reaction between the two epoxy compounds in the cut-off portion of the epoxy stick.

2. Background Art

The invention is intended for use with epoxy putty sticks, and more specifically for use with the two-part epoxy putty sticks commonly sold in hardware stores and elsewhere for plumbing and various repair jobs.

The epoxy stick typically has an inner cylindrical shaped portion and an outer cylindrical shaped portion. Each part contains an epoxy compound which when mixed together chemically react, eventually hardening. A thin inert membrane separates the two portions.

Several problems may be encountered when using the epoxy putty stick, especially by those who are unfamiliar with using the epoxy. The first problem is how to cut off a portion of the epoxy. The desired amount of epoxy may be torn off the stick, however, this generally is not desirable because the torn off end is not neat. A knife is typically used to cut a portion off, however, this also is not desirable because epoxy residue remains on the knife, which then needs to be washed off.

Another problem is that an unfamiliar user may not thoroughly mix the two epoxy compounds well enough. The resultant mixture therefore does not properly harden.

An unfamiliar user may also misjudge the amount of epoxy that is needed, and use too large of a portion. This results in waste and more likely increases the possibility of not mixing the two compounds thoroughly enough.

The last problem is how to store the unused portion of the epoxy putty stick. It is generally not desirable to leave the epoxy unwrapped since part of the epoxy may rub off onto any other items it comes in contact with when it is stored.

The epoxy putty stick holder described herein addresses each of these problems.

SUMMARY OF THE INVENTION

The epoxy putty stick holder has wall portions connected by a flexible joint, which wrap around to store an epoxy putty stick. A connecting means retains the holder in this closed position.

One or more teeth extend from the inner surface of the wall portions to cut off a portion of the epoxy stick when the holder is closed around the epoxy stick. One or more pegs also extend from the inner surface of the wall portions to puncture the cut off portion of the epoxy stick when the holder is closed around the epoxy stick. One or more lips also extend from the inner surface of the wall portions to retain any unused portion of the epoxy stick within the holder between the teeth and the lips of the holder when in a closed position.

A typical use of the epoxy putty stick holder is described as follows. A stick of epoxy putty is lined-up on one end of the stick to the edge of the wall portions closest to the teeth of the holder. The holder which is in the open position is then closed around the epoxy stick, the teeth of the holder cutting a portion of the stick. The teeth are located near one end of the wall portion so that a stick of epoxy putty lined up and cut in this manner yields a portion of epoxy putty which is easily mixed completely. Pegs located between the teeth and end of the wall portion puncture the cut-off portion of epoxy putty to begin the hardening chemical reaction. The holder is then opened and the cut-off portion of the epoxy putty mixed completely by the user and applied before the epoxy hardens. These steps are repeated until enough epoxy has been applied. The remaining unused portion of the epoxy stick may then be stored within the holder for future use by placing the unused portion between the teeth and lips of the holder, and then closing the holder around the remaining portion of the epoxy putty stick holder. The holder is retained in a closed position by a connecting means, and the unused portion of the epoxy putty stick is retained in the holder between the teeth and lips of the holder.

The invention provides an epoxy putty stick holder comprising a plurality of wall portions each connected to an adjacent wall portion by a flexible joint, said epoxy stick holder having an open position in which said wall portions are disposed essentially parallel, and a closed position in which said wall portions are disposed to encircle an epoxy putty stick, connecting means for connecting the outermost wall portions in the closed position, and a tooth portion which extends outwardly from an inner facing surface of at least one of said wall portions, said tooth portion acting to sever a portion of an epoxy putty stick which is closed upon by said epoxy putty stick holder.

The invention also provides an epoxy putty stick holder comprising six flat, rectangular shaped wall portions, each having an inner facing surface and outer facing surface, a flexible joint, hook-and-eye type fastener, a triangular shaped tooth portion extending perpendicularly from the inner facing surface of each wall portion, each being equidistant from a proximal lengthwise end of each wall portion and parallel to each other a peg portion extending perpendicularly from the inner facing surface of each wall portion between the proximal lengthwise end of each wall portion and each tooth, each peg portion being at a different longitudinal distance from the proximal lengthwise end than the peg portion on the adjacent wall portion, and a lip portion which extends from the inner facing surface of each wall portion at the distal lengthwise end of each wall portion, wherein said holder when in an open position, said wall portions are arranged in a straight row, longitudinally parallel to each other, the lengthwise edges of each adjacent wall portion being connected by said flexible joint, the two outermost wall portions having said hook-and-eye type fastener for connecting the outermost wall portions in a closed position, wherein said holder in the closed position, said wall portions encircle an epoxy putty stick.

The holder therefore serves the function of dispensing a selected amount of an epoxy putty stick and storing the unused portion thereof.

DETAILED DESCRIPTION OF THE PREFERRED EMBODIMENTS

Figure 1:
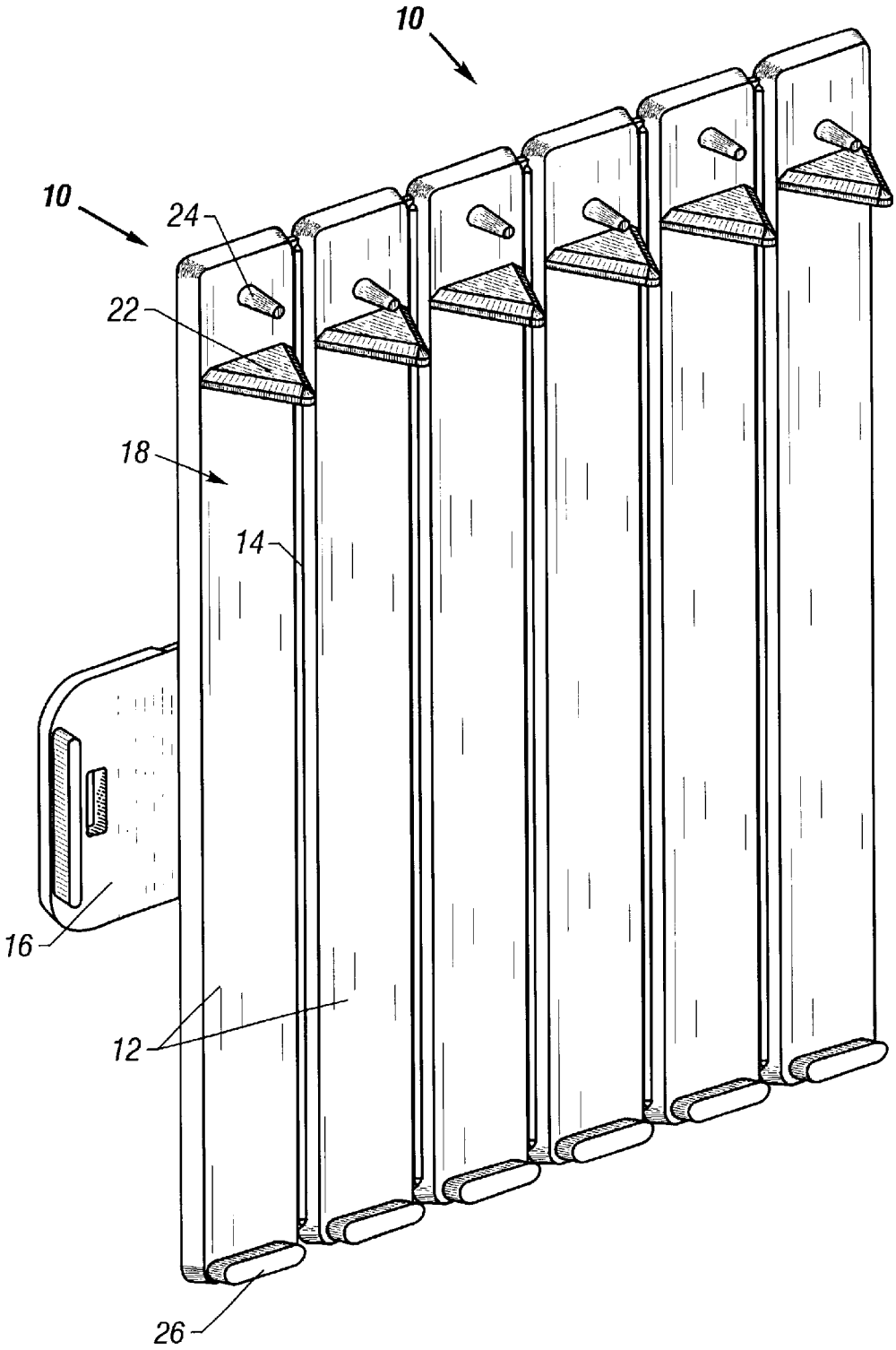
FIG. 1 is a front perspective view of the invention, in the open position.
Figure 2:
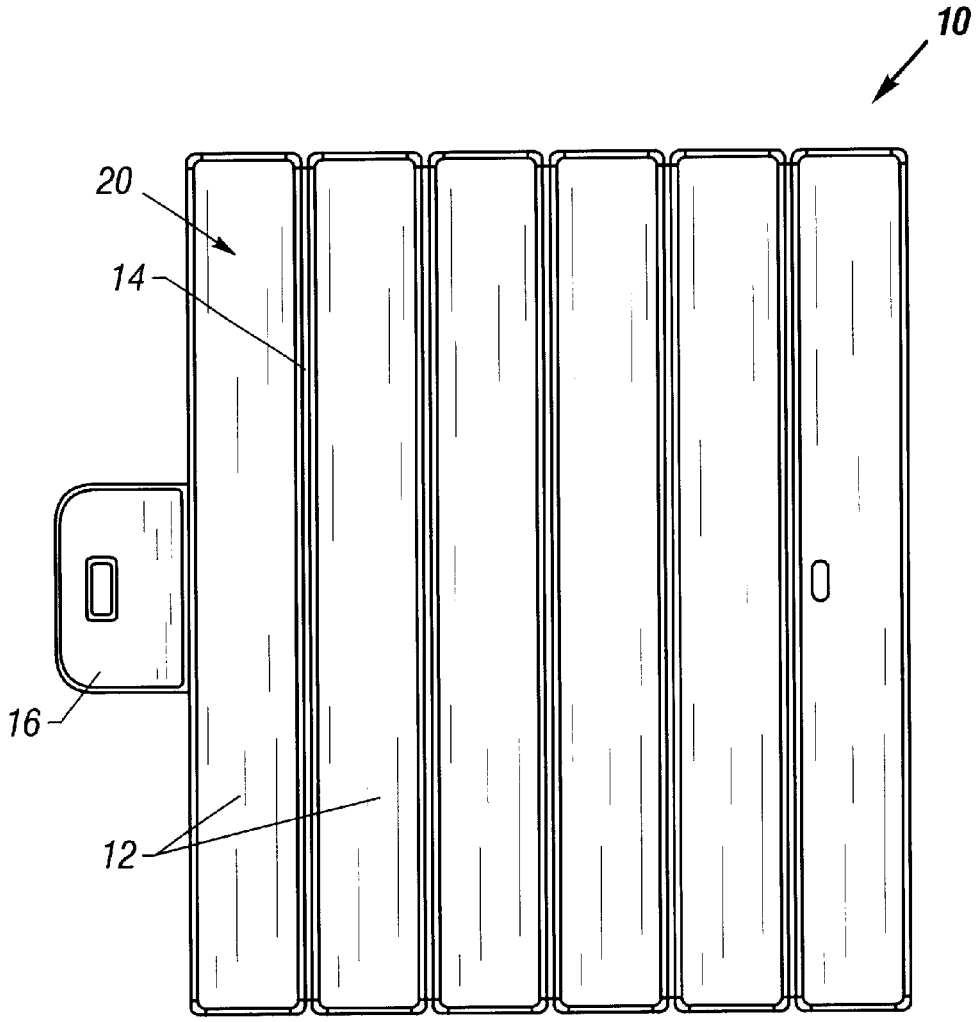
FIG. 2 is a rear view of the invention in the open position.
Figure 3:
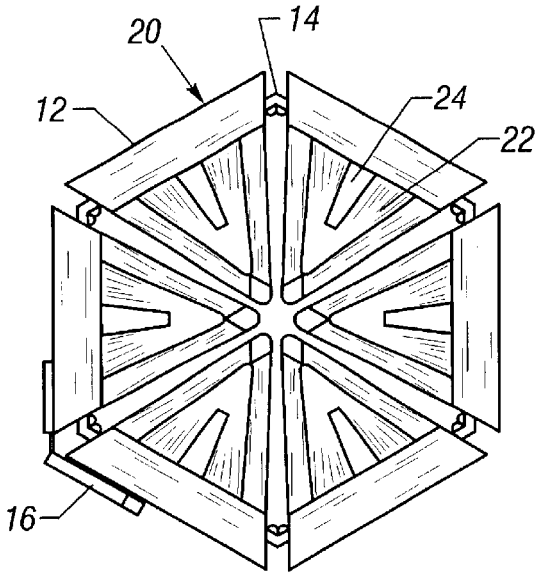
FIG. 3 is an end view of the invention in the closed position.
Figure 4:
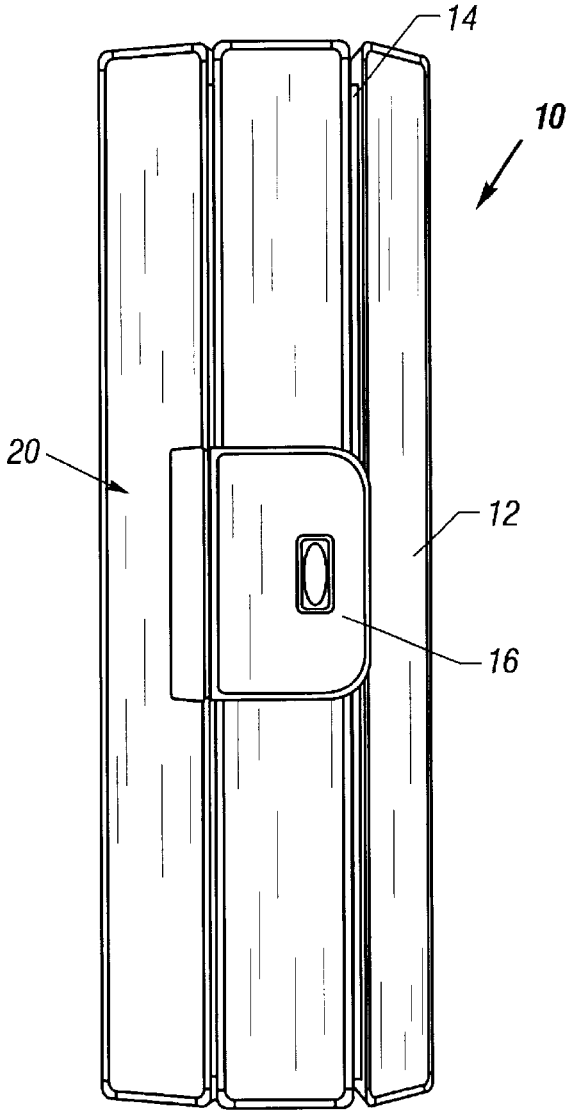
FIG. 4 is a side view of the invention in the closed position.

As shown in the figures, the preferred embodiment of the holder 10 has two or more wall portions 12, each being at least as long as the length of the intended epoxy stick. A flexible joint 14 connects each adjacent wall portion 12 to each other along their respective lengthwise edges. In the closed position, the holder 10 encircles the epoxy stick, and is held in the closed position by connecting means 16. In the closed position each wall portion 12 has an inner surface 18 adjacent to the encircled epoxy stick and an opposite outer surface 20.

On each of the inner surfaces 18 near one of the lengthwise ends of the wall portions 12, a tooth 22 extends outwards from each wall 12. When the holder 10 is closed around an epoxy putty stick, the teeth 22 act to cut the stick.

A peg 24 extends outwards from the inner surface 18 of each wall portion 12 between the lengthwise end proximate to the teeth 22 and each tooth. The pegs 24 act to puncture the cut-off portion of the epoxy-stick to initiate the chemical reaction between the two epoxies contained within the stick. The pegs 24 may also be staggered lengthwise along each wall portion so that the pegs 24 do not contact each other and prevent the device from closing when wrapped around the epoxy stick.

A lip 26 extends outwards from the inner surface 18 of each wall portion 12, at the lengthwise end distal to the teeth 22 and pegs 24. The lips 26 act to prevent the epoxy stick from sliding out the one end of the device 10 when closed around the epoxy stick.

The epoxy putty stick holder of the present invention may be modified in several ways including, but not limited to, varying the number and shape of the wall portions, the teeth, the pegs, and the lips.

What is claimed is:

1. An epoxy putty stick holder comprising:

a plurality of wall portions each connected to an adjacent well portion by a flexible joint, said epoxy stick holder having an open position in which said wall portions are disposed essentially parallel, and a closed position in which said wall portions are disposed to encircle an epoxy putty stick, connecting means for connecting the outermost wall portions in the closed position, a tooth portion which extends outwardly from an inner facing surface of at least one of said wall portions, said tooth portion acting to sever a portion of an epoxy putty stick which is closed upon by said epoxy putty stick holder, and a peg portion which extends outwardly from the inner facing surface of at least one of said wall portions, said peg portion acting to puncture said severed portion of the epoxy stick to initiate a chemical reaction between the epoxies in the stick.

2. The epoxy putty stick holder of claim 1 wherein a tooth portion extends outwardly from the inner facing surface of each of said wall portions.

3. The epoxy putty stick holder of claim 1 wherein said connecting means is a hook-and-eye type fastener.

4. The epoxy putty stick holder of claim 1 wherein a peg portion extends outwardly from the inner facing surface of each of said wall portions.

5. The epoxy putty stick holder of claim 4 wherein said peg portions each extend outwardly from each respective wall portion at a different longitudinal distance from a lengthwise end of each respective wall portion than the peg portion extending from an adjacent wall portion such that said peg portions do not come into contact with each other peg portion when said epoxy putty stick holder Is In the closed position.

6. The epoxy putty stick holder of claim 5 wherein said peg portions are alternatively staggered longitudinally along each respective wall portion.

7. An epoxy putty stick holder comprising;

a plurality of wall portions each connected to an adjacent wall portion by a flexible joint, said epoxy stick holder having an open position in which said wall portions are disposed essentially parallel, and a closed position in which said wall portions are disposed to encircle an epoxy putty stick, connecting means for connecting the outermost wall portions in the closed position, a tooth portion which extends outwardly from an inner facing surface of at least one of said wall portions, said tooth portion acting to sever a portion of an epoxy putty stick which Is closed upon by said epoxy putty stick holder a lip portion which extends outwardly from the inner facing surface of at least one of said wall portions, said lip portion acting to hold the epoxy putty stick within the epoxy putty stick holder in the closed position, between said tooth portion and said lip portion.

8. The epoxy putty stick holder of claim 7 wherein a lip portion extends outwardly from the inner facing surface of each of said wall portions.

9. An epoxy putty stick holder comprising:

six flat, rectangular shaped wall portions, each having an inner facing surface and outer facing surface;

a flexible joint;

hook-and-eye type fastener;

a triangular shaped tooth portion extending perpendicularly from the inner facing surface of each wall portion, each being equidistant from a proximal lengthwise end of each wall portion and parallel to each other;

a peg portion extending perpendicularly from the inner facing surface of each wall portion between the proximal lengthwise end of each wall portion and each tooth, each peg portion being at a different longitudinal distance from the proximal lengthwise end than the peg portion on the adjacent wall portion; and a lip portion which extends from the inner facing surface of each wall portion at the distal lengthwise end of each wall portion;

wherein said holder when In an open position, said wall portions are arranged in a straight row, longitudinally parallel to each other, the lengthwise edges of each adjacent wall portion being connected by said flexible joint, the two outermost wall portions having said hook-and-eye fastener for connecting the outermost wall portions in a closed position, wherein said holder in the dosed position, said wall portions encircle an epoxy putty stick.

10. The epoxy putty stick holder of claim 7 wherein a tooth portion extends outwardly from the inner facing surface of each at said wall portions.

11. The epoxy putty stick holder of claim 7 wherein said connecting means is a hook-and-eye type fastener.

12. The epoxy putty stick holder of claim 7 wherein a peg portion extends outwardly from the inner facing surface of each of said wall portions.

13. The epoxy putty stick holder of claim 12 wherein said peg portions each extend outwardly from each respective wall portion at a different longitudinal distance from a lengthwise end of each respective wall portion than the peg portion extending from an adjacent wall portion such that said peg portions do not come into contact with each other peg portion when said epoxy putty stick holder is in the closed position.

14. The epoxy putty stick holder of claim 13 wherein said peg portions are alternatively staggered longitudinally along each respective wall portion.

* * * * *